US006860316B2

(12) United States Patent
Wu et al.

(10) Patent No.: US 6,860,316 B2
(45) Date of Patent: Mar. 1, 2005

(54) MATERIAL MELTING DEVICE OF METAL INJECTION MOLDING MACHINE

(76) Inventors: Chi Yin Wu, 235 Chung-Ho Box 8-24, Taipei (TW); Hou Wang, 235 Chung-Ho Box 8-24, Taipei (TW); Chirn Shun Hsn, 235 Chung-Ho Box 8-24, Taipei (TW)

( * ) Notice: Subject to any disclaimer, the term of this patent is extended or adjusted under 35 U.S.C. 154(b) by 28 days.

(21) Appl. No.: 10/338,543

(22) Filed: Jan. 6, 2003

(65) Prior Publication Data

US 2004/0129400 A1 Jul. 8, 2004

(51) Int. Cl.[7] ..... B22D 17/10; B22D 23/00; B22D 25/00

(52) U.S. Cl. ..... 164/312; 164/113; 164/900

(58) Field of Search ..... 164/113, 312, 164/900

(56) References Cited

U.S. PATENT DOCUMENTS 5,711,363 A * 1/1998 Scruggs et al. ..... 164/113
6,059,012 A * 5/2000 Vining et al. ..... 164/312
6,405,784 B2 * 6/2002 Takizawa et al. ..... 164/113

* cited by examiner

*Primary Examiner*—Kuang Y. Lin

(57) ABSTRACT

A material melting device of metal injection molding machine comprises a main feeding cylinder; a plurality of preheating feed cylinders parallel arranged at a lateral side of a main feeding cylinder of a metal injection molding machine; a plurality of material outlets formed at a side of each preheating feed cylinder. The material outlets are communicated to the main feeding cylinder through the guide tubes. Thereby, an inner side of the preheating feed cylinder is pre-heated so as to get preheated grains by adjusting the preheating screw rods in the preheating feed cylinder. Moreover, the preheating feed cylinders can be replaced by feeding funnels and the guide tubes are replaced by heating pipes.

1 Claim, 4 Drawing Sheets

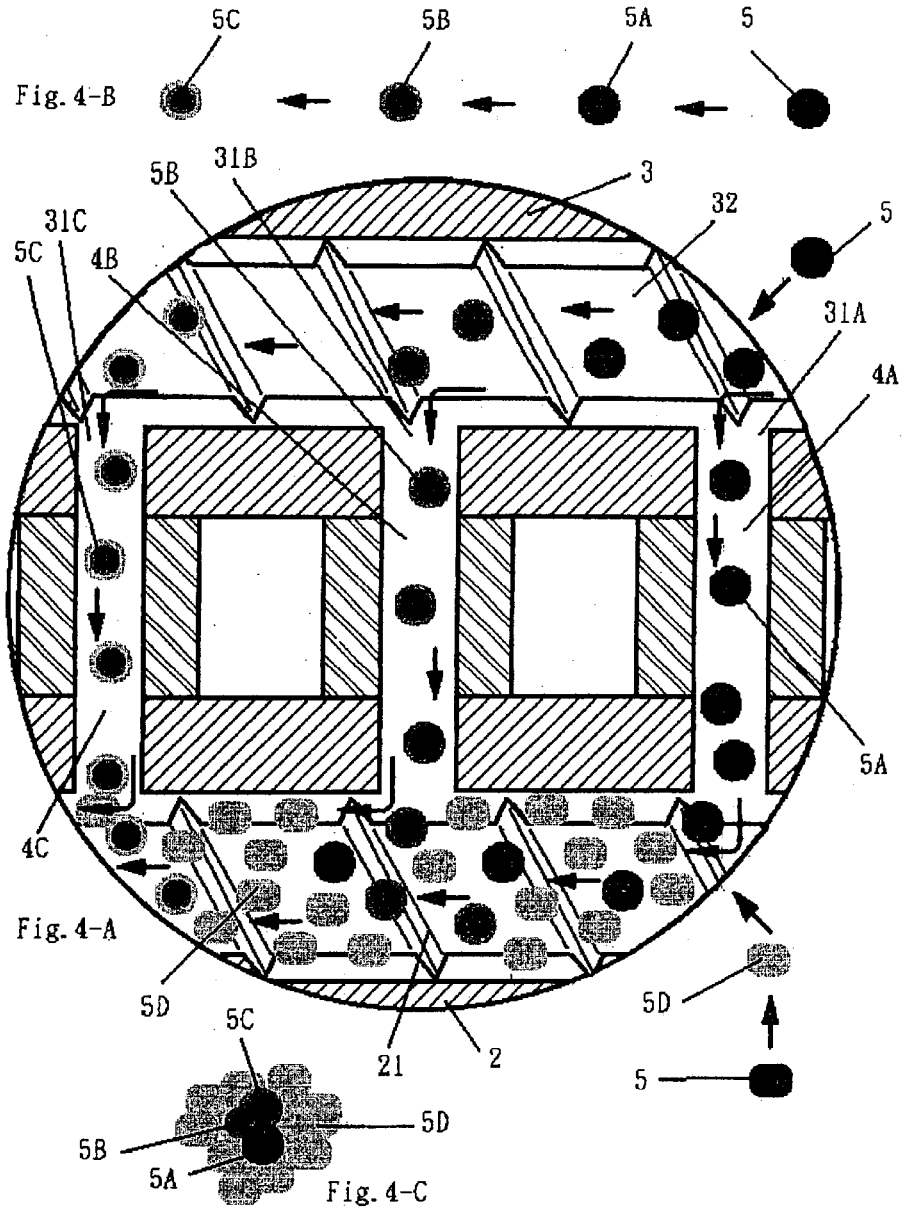
5C
5B
5A
5
Fig. 4-B
5B
31B
3
32
5
31C
5C
4B
31A
4A
5A
4C
Fig. 4-A
5D
5D
21
2
5
5C
5D
5B
5A
Fig. 4-C

MATERIAL MELTING DEVICE OF METAL INJECTION MOLDING MACHINE

FIELD OF THE INVENTION

The present invention relates to metal injection molding machines, and particularly to a material melting device of a metal injection molding machine which causes that the injecting material has a solid structure so that the surface of the product is smooth.

BACKGROUND OF THE INVENTION

Injecting machines are mainly used with shaping molds for forming products. Materials are heated, extruded and then fed into a mold. Conventionally plastic material is used due to a low melting point, small grain sizes and preferred uniformity. Moreover, in the process of storage and injection, the material has no bubble therein.

Currently, many products, for example, computer casings, use metals as material (for example, aluminum) for replacing plastic material. However, metals are heavy and dense than plastics. Moreover, the grains of the metal after melting are not so uniform as plastic grains. Thereby, conventionally, a feeding screw rod with screw threads at the middle section is used to feed material, but this will induce bubbles to be accumulated in the metal material. As a result, the surface of the product is not uniform or gaps are formed in the wall of the product.

Referring to FIG. 1, a prior art thixomolding method disclosed in U.S. Pat. No. 5,040,589 is illustrated. In this conventional way, metal grains are machined into a great deal of chips. Thereby, in transferring by the feeding screw rod, it is heated as a mixing structure containing solid grains and liquids, and for a long period, the material becomes a viscous material. The defect of this prior art is that the chip must be retained in a viscous condition, neither liquid nor solid can exist therein. This is very difficult, especially to control the temperature in operation.

Referring to FIG. 2, a first class rheomolding method disclosed in U.S. Pat. No. 6,405,784 is shown. In this prior art way, the device used is improved from the conventional used one. Grain-like material is melt as liquid in a transversal material feeding cylinder. Then the material is fed to a following inclined cylinder by using a piston. Then the melt material is pushed into a mold by the piston.

Referring to FIG. 3, a first class rheomolding method disclosed in U.S. Pat. No. 5,501,266 is shown. In this prior art way, the device used is improved from the conventional used one. The block-like metal is melt and thus is supplied to a screw rod so that melt material can be injected into a mold.

In above two Rheomolding methods, the melting metal must be retained in a viscous state from a liquid state for being placed in the mold to form a desired shape. Thereby, the temperature must be reduced from a high temperature. However, this is difficult in a long and continuous operation. To control the metal in a steady state is very difficult. Moreover, these two methods generate more bubbles than the prior art method so that the smoothness of the product is not preferred.

SUMMARY OF THE INVENTION

Accordingly, the primary object of the present invention is to provide a material melting device of metal injection molding machine. The device comprises a main feeding cylinder; a plurality of preheating feed cylinders being parallel arranged at a lateral side of a main feeding cylinder of a metal injection molding machine. A plurality of material outlets are formed at a side of each preheating feed cylinder. The material outlets are communicated to the main feeding cylinder through the guide tubes. Thereby, an inner side of the preheating feed cylinder is pre-heated so as to get preheated grains by adjusting the rotating speed of the preheating screw rod in the preheating feed cylinder. In operation, the material is heated due to the friction between the material and the surface of the rotating screw rod. Thus, no external heating device is necessary for heating the preheating feed cylinder and the main feeding cylinder.

The various objects and advantages of the present invention will be more readily understood from the following detailed description when read in conjunction with the appended drawing.

BRIEF DESCRIPTION OF THE DRAWINGS

FIG. 4A is a partial enlarged schematic view of the coating molding operation of the present invention.

FIG. 4B is a schematic view showing the preheating process of the coating molding of the present invention.

FIG. 4C is a schematic view showing that the preheated grains are mixed with melt material in the coating molding method of the present invention.

BRIEF DESCRIPTION OF THE PREFERRED EMBODIMENTS

Figure 1:
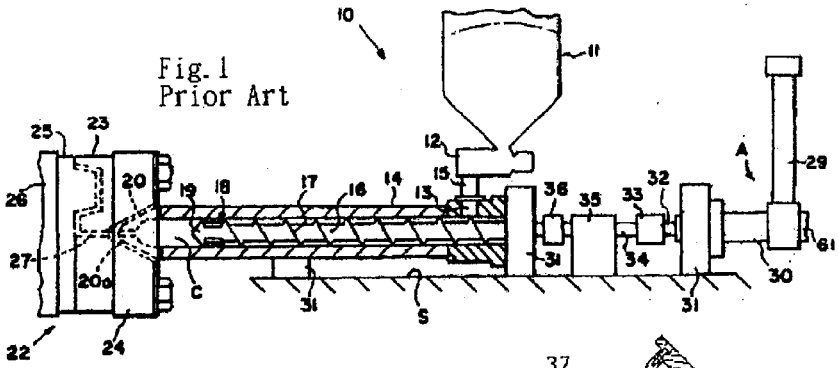
Fig. 1 Prior Art
FIG. 1 shows an operational structure of a prior art thixomolding method.
Figure 2:
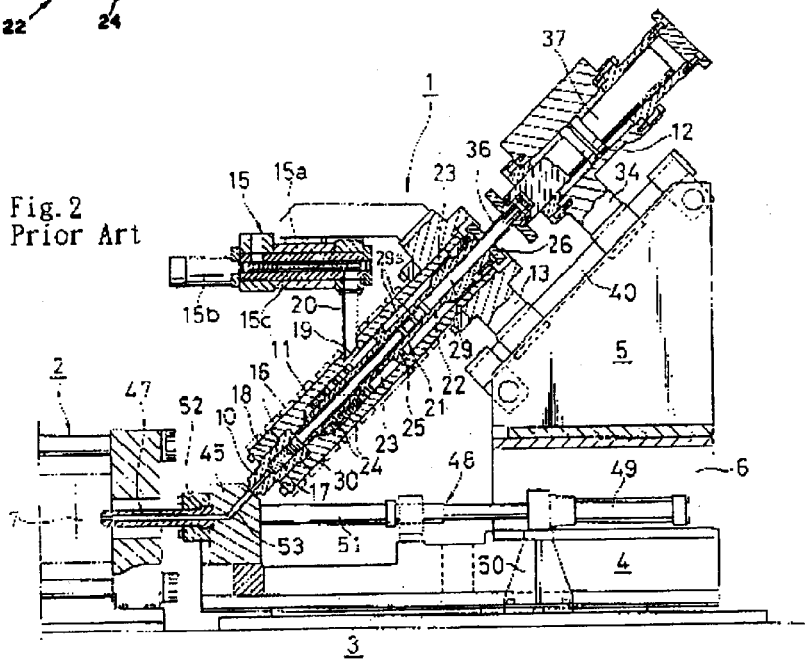
Fig. 2 Prior Art
FIG. 2 shows an operational structure of a prior art first class rhomolding method.
Figure 3:
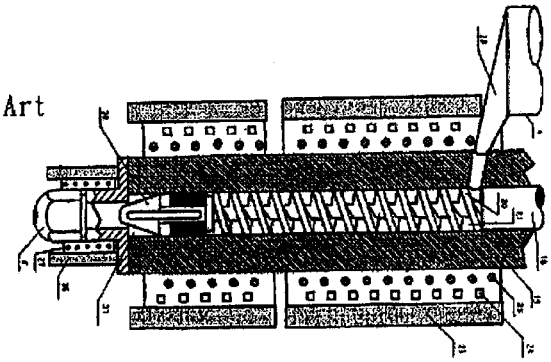
Fig. 3 Prior Art
FIG. 3 is an operational structure of a prior art second class rohmolding method.
Figure 4:
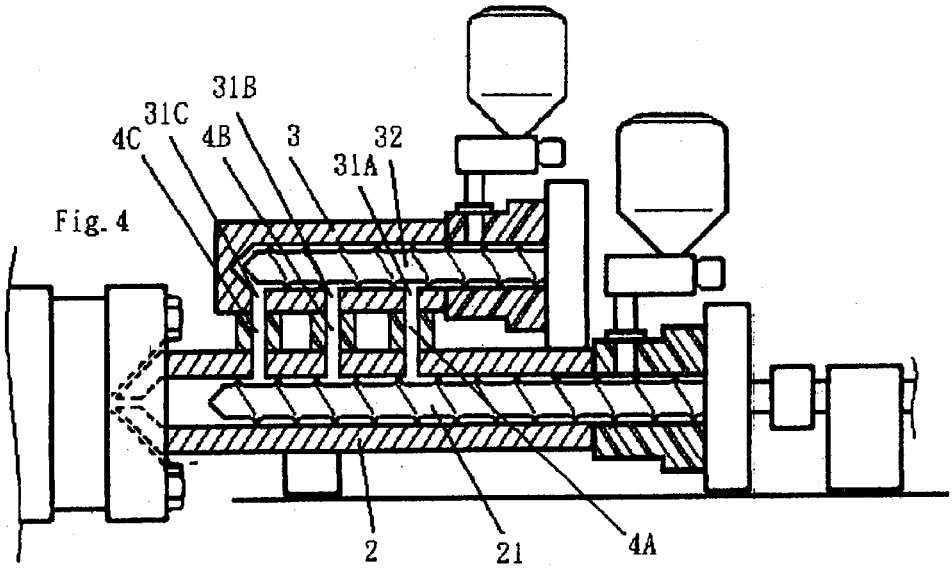
FIG. 4 is a schematic view about the operation structure of the coating molding of the present invention.
Figure 5:
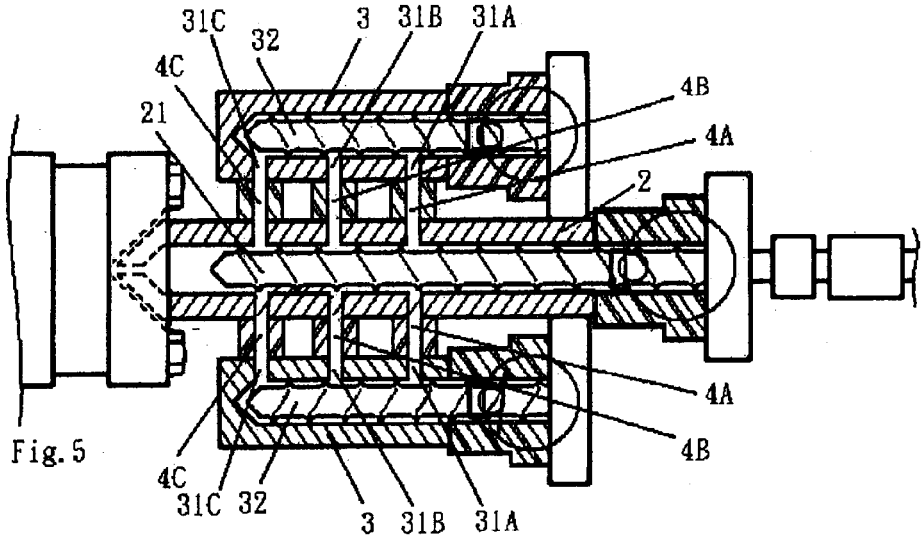
FIG. 5 shows a structural schematic view of the present invention.

Referring to FIGS. 4 and 4A, in the present invention, a lateral side of a main feeding cylinder 2 of a metal injection molding machine is arranged with a plurality of preheating feed cylinders 3 which are parallel arranged. A side of each preheating feed cylinder 3 is formed with a plurality of material outlets 31A, 31B and 31C. The material outlets 31A, 31B and 31C are communicated to the main feeding cylinder 2 through the guide tubes 4A, 4B and 4C. Thereby, the inner side of the preheating feed cylinder 3 can be, pre-heated so as to get preheated grains 5A, 5B and 5C by adjusting rotating speed of the preheating screw rods 32 in the preheating feed cylinders 3.

The material 5 drops into the main feeding cylinder 2 from the material outlets 31A, 31B and 31C. The material 5 dropped from the material outlet 31A forms the preheated grains 5A which are hard, the material 5 dropped from the material outlet 31B forms the preheated grains 5B, the material 5 dropped from the material outlet 31C forms the preheated grains 5C. The preheated grain 5A are harder than preheated grains 5B and the preheated grains 5B are harder than preheated grains 5C.

Moreover, the material 5 is directly supplied to the main feeding cylinder 2, and thus it is formed as a liquid material 5D which are mixed with the preheated grains 5A, 5B and 5C.

In the present invention, the number of the material outlets are changeable according to the property of the material and other conditions. Moreover, the number of the preheating feed cylinders 3 are also changeable.

Figure 6:
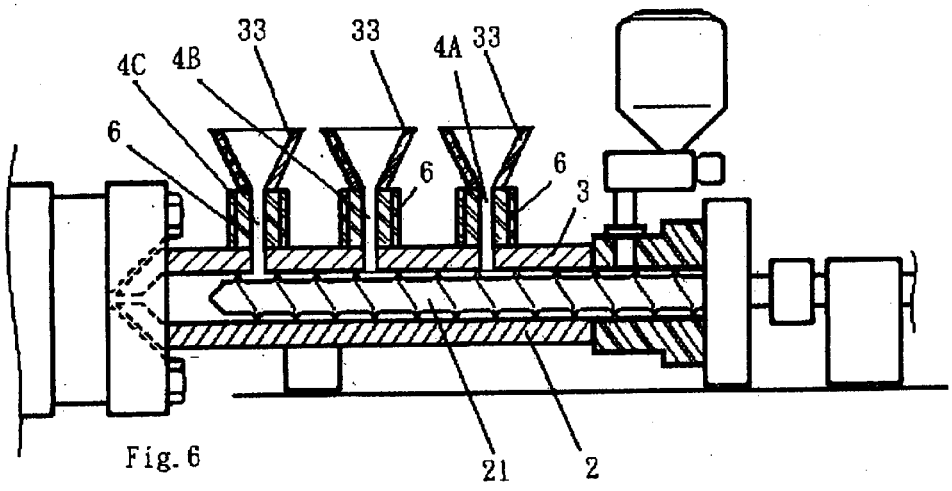
FIG. 6 is a schematic view showing another embodiment of the present invention.

Referring FIG. 6, the second embodiment of the present invention is illustrated. In this the present invention, the material outlets may be replaced by feeding funnels 33 and the guide tube is replaced by heating pipes 6. This arrangement can generate the same effect as the previous embodiment.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A material melting device of metal injection molding machine comprising a main feeding cylinder;

a plurality of preheating feed cylinders being parallel arranged at a lateral side of the main feeding cylinder of a metal injection molding machine;

a plurality of material outlets being formed at a side of each preheating feed cylinder; the material outlets being communicated to the main feeding cylinder through the guide tubes; thereby, an inner side of the preheating feed cylinder being pre-heated to get pre-heated grains by adjusting the rotating speed of pre-heating screw rods in the preheating feed cylinders;

wherein material drops into the main feeding cylinder from the material outlets to be as preheated grains; moreover, another material is directly supplied to the main feeding cylinder by adjusting the rotating speed of a preheating screw rod in the main feeding cylinder, and thus it is formed as a liquid material which are mixed with the preheating grains.

* * * * *